US007966998B2

(12) United States Patent
Wade

(10) Patent No.: US 7,966,998 B2
(45) Date of Patent: Jun. 28, 2011

(54) NITROUS OXIDE, FUEL INJECTION COMBINED PLATE AND NOZZLE UNIT

(75) Inventor: Randy Stewart Wade, Clearwater, FL (US)

(73) Assignee: Randy S. Wade, Clearwater, FL (US)

( * ) Notice: Subject to any disclaimer, the term of this patent is extended or adjusted under 35 U.S.C. 154(b) by 455 days.

(21) Appl. No.: 12/229,620

(22) Filed: Aug. 26, 2008

(65) Prior Publication Data

US 2010/0051002 A1 Mar. 4, 2010

(51) Int. Cl.
*F02B 23/00* (2006.01)

(52) U.S. Cl. ..... 123/585; 123/1 A; 123/531

(58) Field of Classification Search ..... 123/1 A, 123/531, 575, 585, 590, 198 A
See application file for complete search history.

(56) References Cited

U.S. PATENT DOCUMENTS 6,837,228 B2 * 1/2005 Baasch et al. ..... 123/585

* cited by examiner

*Primary Examiner* — Noah Kamen

(57) ABSTRACT

The present invention is a nitrous oxide and fuel injection apparatus for an internal combustion engine and is used to increase horsepower for use such as in racing. It is mounted between the carburetor and the intake manifold having passages to allow the communication of the mixture from the carburetor to the intake manifold. The module supplies a center section that has two chambers one for fuel and one for nitrous oxide. The nitrous oxide and the fuel are feed to conduits exiting the module with the nitrous oxide conduit being inside of the fuel conduit. The feed conduits distal open ends is in or pointed at the intake runner form the nitrous oxide and fuel spray nozzle that will spray their mixture into the air and fuel mixture from the carburetor when the nitrous system is activated to give the increase in horsepower.

6 Claims, 3 Drawing Sheets

NITROUS OXIDE, FUEL INJECTION COMBINED PLATE AND NOZZLE UNIT

CITED REFERENCE U.S. PATENT DOCUMENTS

| | | |
|---|---|---|
| 5,839,418 | NOV, 24, 1998 | GRANT |
| 5,890,476 | APR, 6, 1999 | GRANT |
| 4,827,888 | MAY 9, 1989 | VAZNAIAN |
| 6,520,165 | FEB. 18, 2003 | STEELE |
| 5,699,776 | DEC. 23, 1997 | WOOD |
| 5,743,241 | APR. 28, 1998 | WOOD |
| 6,116,225 | SEP. 12, 2000 | THOMAS |
| 6,378,512 | APR. 30, 2002 | STAGGEMEIER |

STATEMENT REGARDING FEDERALLY SPONSORED RESEARCH OR DEVELOPMENT

Not applicable

REFERENCE TO SEQUENCE LISTING, OR A COMPUTER PROGRAM LISTING COMPACT DISC APPENDIX

Not applicable

BACKGROUND OF THE INVENTION

The present invention relates to the field of the high performance internal combustion engine, more particularly what are know in the field as power adders. More particularly the present invention is in the field of, nozzles and plates for injecting nitrous oxide or other oxidizer and fuel into an internal combustion engine.

When nitrous oxide is injected into the intake tract of an internal combustion engine it can produce additional horsepower. During World War II the Germans developed the GM 1 Boost system, a nitrous oxide injection system to allow them to fly faster and reach higher altitudes in their airplanes. Nitrous oxide injection has re-emerged with the popularity of drag racing and has become a large industry. It has also been used in the field of amateur and test rocketry.

Nitrous oxide breaks down into nitrogen and oxygen when heated to a particular temperature such as, in the combustion chamber of the internal combustion engine. Generally, additional fuel must also be added to compensate for the additional oxygen. Introducing nitrous oxide into the combustion chamber 35 accomplishes this increase in horsepower due to the increase of oxygen, as nitrous oxide has 36% oxygen by weight compared to 23% oxygen by weight in air according to most articles to be found. The prior art of nozzles and or plates are understood in the field of nitrous oxide and fuel injection to be part of a system consisting of, storage vessels for nitrous oxide and fuel, additionally conduits, fittings, valves, pumps, switches and wiring make up just some of the parts that may or may not be used to build a nitrous oxide and fuel injection system. The nitrous systems purpose is to provide a supply of nitrous oxide and fuel to the nozzle or plate where it is emitted or sprayed into the intake tract and can be used by the engine to produce extra horsepower or torque levels above what the engine would normally produce.

Prior art Barry Grant Nov. 24, 1998 U.S. Pat. No. 5,839,418, Wood Apr. 28, 1998 U.S. Pat. No. 5,743,241, and Staggemeier Apr. 30, 2002 are plate or module type injectors and are mounted between the carburetor and the intake manifold. The disadvantage with the plate type injection system is; the distance and route that the fuel laden mixture must travel before reaching the combustion chamber.

Hence in some applications these plate type systems perform at an expectable level of performance, but at higher performance levels as more nitrous oxide and fuel are required the air nitrous oxide and fuel mixture can breakdown causing some combustion chambers to burn lean and some to burn rich causing lower levels of performance and possible engine damage. The advantage of prior art plate type systems is the ease of the install and a minimum of plumbing that is required.

The prior art Barry Grant Apr. 6, 1999 U.S. Pat. No. 5,890,476, Vaznaian May 9, 1989, U.S. Pat. No. 4,827,888, Steele Feb. 18, 2003, U.S. Pat. No. 6,520,165 B1, Wood Dec. 23 1997, U.S. Pat. No. 5,699,776, and Thomas Sep. 12, 2000 U.S. Pat. No. 6,116,225 nitrous oxide and fuel nozzles have allowed for higher levels of performance to be obtained than by prior art plate type systems by placing a nozzle or nozzles closer to the combustion chamber thereby, deceasing the distance and straightens the route that the nitrous oxide and fuel mixture must travel. The results being less breakdown of said mixture. The disadvantages of the nozzle type systems are many with this type of system you must drill and tap each intake runner near the combustion chamber, drilling and tapping could necessitate the removal of the intake manifold to accomplish the installation of a nozzle type system. Another disadvantage of prior art nozzle type systems is the large amount of plumbing work that must be undertaken during the installation of said system. Thus it would be desirable to have the higher performance of a nozzle type system with the ease of installing a plate type system.

BRIEF SUMMARY OF THE INVENTION

Briefly described the present invention is a nitrous oxide and fuel injection apparatus for an internal combustion engine. The present invention is mounted in an intake tract of the internal combustion engine it is comprised of a module mounted between the carburetor and the intake manifold having passages to allow the communication of the air and fuel mixture from the carburetor to the intake manifold. The said module or plate as it is referred to in the field has nitrous oxide and fuel inlet ports that receive their constituent from a nitrous system (not part of the present invention). Nitrous oxide and fuel conduits connected to the module supply a center section that has two chambers one for nitrous oxide and one for fuel. Nitrous oxide feed conduits and the fuel feed conduits are affixed to their respective chambers of the center section with the nitrous oxide feed conduits passing through the floor of the nitrous oxide chamber and passing through the fuel chamber then passing through the center of the fuel feed conduits that receive fuel from the fuel chamber. In the present invention the nozzles are a conduit within a conduit, the most interior conduit being the nitrous oxide conduit. The distal ends of the feed conduits point into the intake runner or extend down the intake runner and point at the intake port, this distal end has an open ended nitrous oxide conduit and an open ended fuel conduit that forms a spray nozzle or nozzles dependant on the number of cylinders that the engine has. The feed conduits are made of a material which allows the nozzle ends to be manipulated to spray their respective intake runner with a mixture of nitrous oxide and fuel.

Thus it is an object of the present invention to supply nitrous oxide and fuel to an internal combustion engine and provide a convenient method of getting the high performance of a nozzle type system and the ease of the simpler plate or module type installation.

DETAILED DESCRIPTION OF THE INVENTION

The present invention is the injection part of a system familiarly known in the field of nitrous oxide and fuel injection as a nitrous system. The term nitrous system herein will denote a system that provides the nitrous oxide and fuel to the present invention at amounts and pressures generally excepted as standards in the field of nitrous oxide and fuel injection. The present invention is versatile in that it can be used on a single cylinder internal combustion engine or a multiple cylinder internal combustion engine or rotary engine. Furthermore for explanation purposes a simplified drawing of the present invention mounted on a single cylinder internal combustion engine is used.

Figure 1:
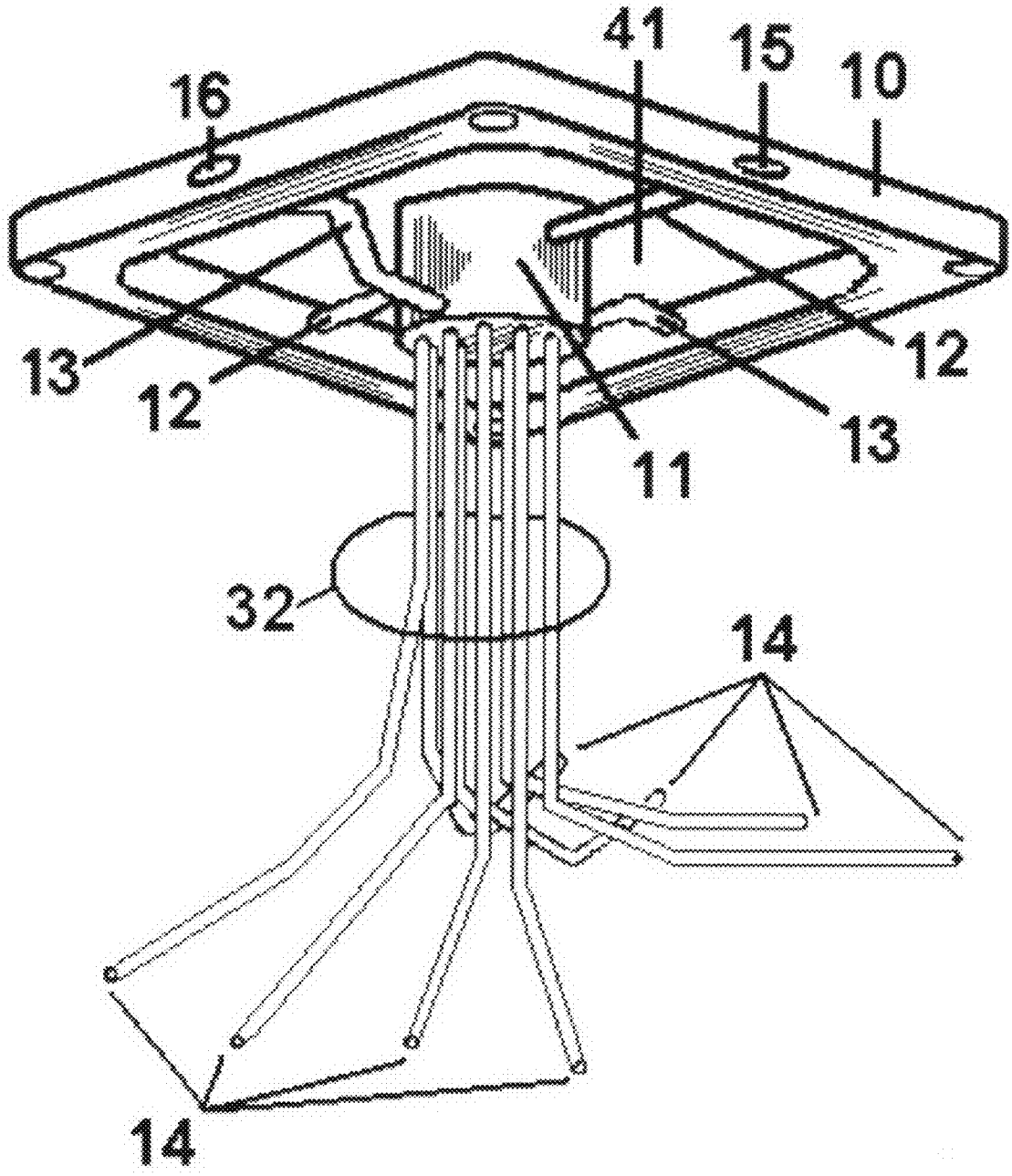
FIG. 1 is a perspective view of the nitrous oxide, fuel Injection combined plate and nozzle unit.

Referring now in more detail to the drawings in which like numerals indicate like parts throughout several views, FIG. 1 illustrates the Nitrous Oxide, Fuel Injection Combined Plate and Nozzle Unit which has a plate or module 10 that will be referred to as a module 10 herein. In the preferred embodiment the said module 10 is sized and shaped to be positioned between the carburetor 27 (not shown in this view, not part of the present invention) and the intake manifold 28 (not shown in this view, not part of the present invention) of an internal combustion engine (not shown in this view, not part of the present invention). A common fitting (not shown in this view, not part of the present invention) used in nitrous systems is threaded into the module's 10 supply ports 15, 16. The said common fittings hold a jet or orifice which can be changed to adjust the amount of the fuel and nitrous oxide provided to the present invention. Still referring to FIG. 1 the fuel supply port or ports 16 and the nitrous supply port or ports 15 are drilled through the module 10 so as to form passages from the said common fittings to their respective supply conduits 12, 13. Still referring to FIG. 1 and the said conduits 12, 13 that convey their respective constituent from the supply ports 15, 16 to a center section herein referred to as the two chamber collector assembly 11 where it is distributed to the fuel feed conduit or conduits 32 and nitrous oxide feed conduit or conduits 19 (not shown in FIG. 1) respectively. Now referring to FIG. 2 and the nitrous oxide supply conduit or conduits 12 which have an internal diameter area slightly larger than the internal diameter area of the nitrous oxide feed conduits 19 multiplied by the number of said feed conduits 19. In substitution of a relatively large supply conduit 12 multiple supply conduits 12 could be used. In the preferred embodiment the fuel supply conduit or conduits 13 and fuel feed conduit or conduits 32 are larger than needed and adjustment to the amount of fuel emitted is done with the previously mentioned jets or orifices. Furthermore the fuel supply conduits 13 shown in FIG. 1 are bent or angled toward and into the module 10 so that they can be affix and sealed to the two chamber collection assembly 11 and the module 10.

Figure 4:
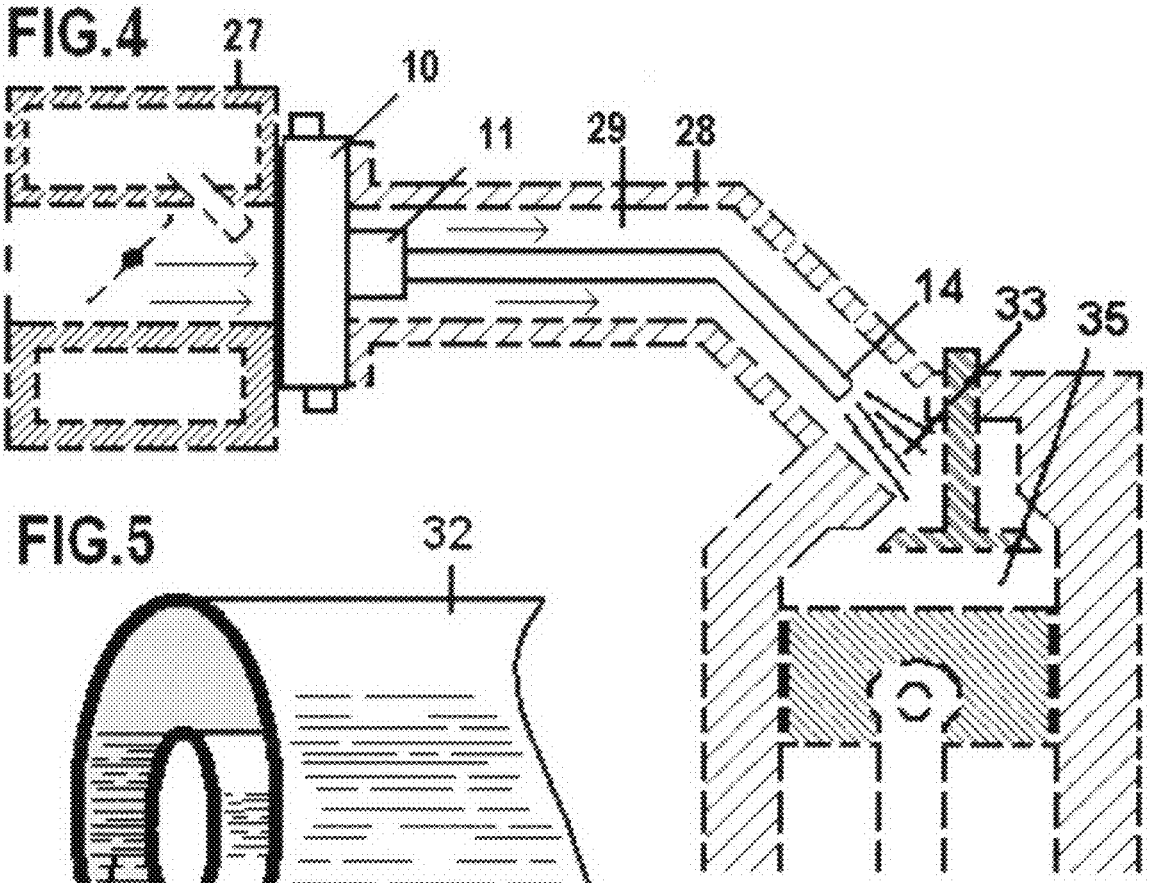
FIG. 4 is a cross-sectional view illustrating placement on a single cylinder engine without internal details of the present invention. Broken lines not part of present invention.

Referring now to FIG. 4 an illustrated drawing showing the present inventions placement on a single cylinder engine (without the internal details of the two chamber collection assembly 11 or the module 10) the module 10 is shown mounted between the carburetor 27 and the intake manifold 29. Still referring to FIG. 4 and the module 10 which has passages 41 to allow the flow of fuel and air mixture from the carburetor 27 to the intake manifold 28, the said air and fuel mixture from the carburetor 27 is represented by the arrowed lines.

Figure 2:
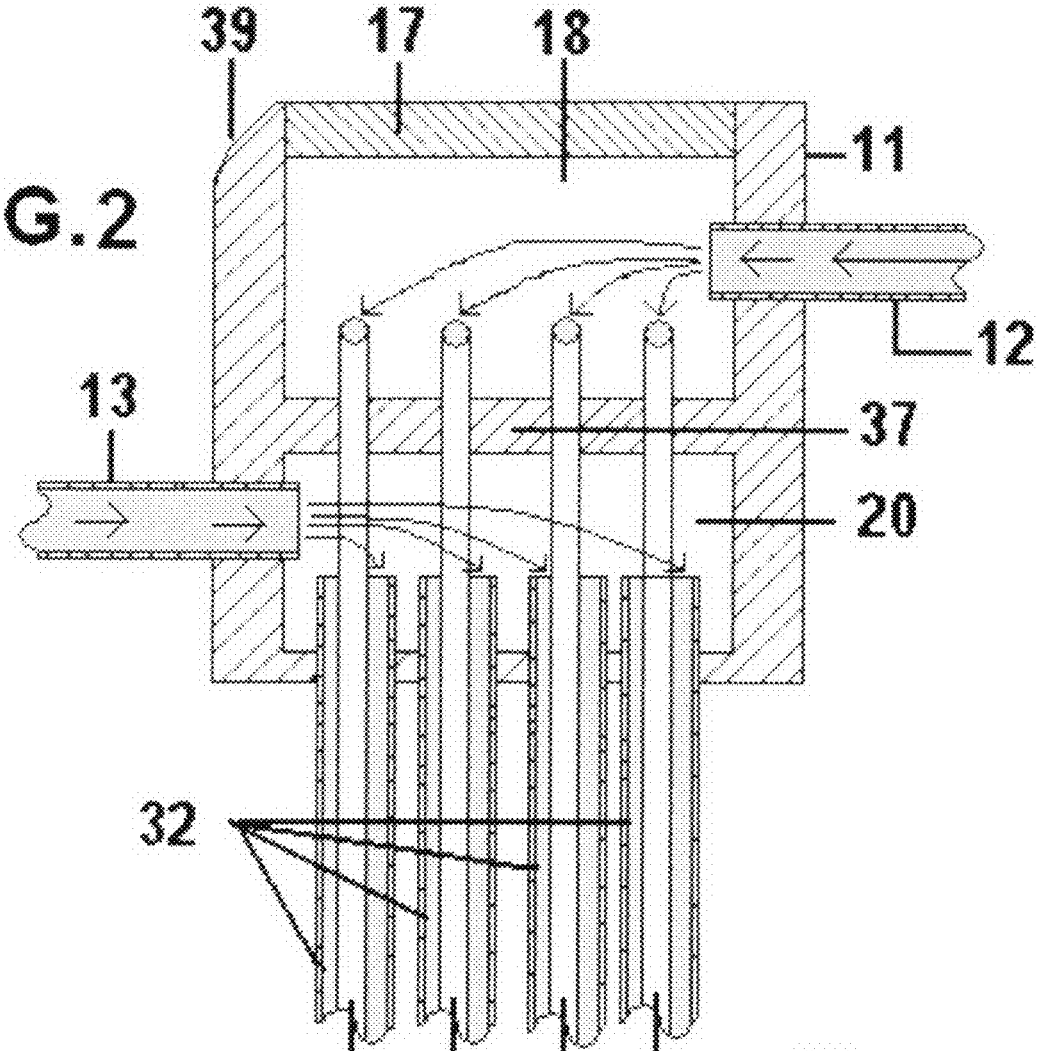
FIG. 2 is a cross-sectional view of the two chamber collection assembly.
Figure 3:
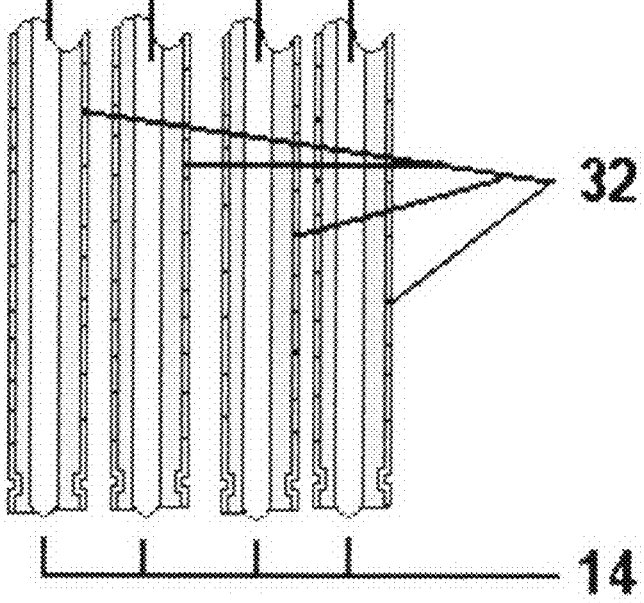
FIG. 3 is a cross-sectional view of the nitrous oxide and fuel feed conduits.

Now referring to FIGS. 2 and 3 where gray shaded areas represent the interior of conduits 32, 12, 13, 19 and arrowed lines are used to illustrate the flow of the nitrous oxide and fuel. Still referring to FIGS. 2 and 3 and the flow of the nitrous oxide entering the nitrous oxide collection chamber 18 of the two chamber collector assembly 11 from the nitrous oxide supply conduit 12 where it is conveyed into the nitrous oxide feed conduits 19 supply end, because of the pressure differential between the nitrous oxide collection chamber 18 and the nitrous oxide feed conduit or conduits 19 with their open distal ends 14 terminating near the end of the fuel feed conduit or conduits 32 in the intake manifold 28 (not shown in this view) where the pressure is much less or even negative compared to the pressure in the nitrous oxide collection chamber 18.

Now referring to FIG. 2 where fuel is supplied by the fuel supply conduits 13 to the fuel chamber 20 of the two chamber collection assembly 11 and conveyed into the fuel feed conduits 32 supply end because of the pressure differential between the fuel chamber 20 and the fuel feed conduit or conduits 32 with their open distal ends 14 terminating near the end of the nitrous oxide feed conduits 19 in the intake manifold 28 (not shown in this view) where the pressure is much less or even negative compared to the pressure in the fuel collection chamber 20, fuel is emitted with the nitrous oxide at the nozzle end 14 as illustrated in FIG. 4.

Figure 5:
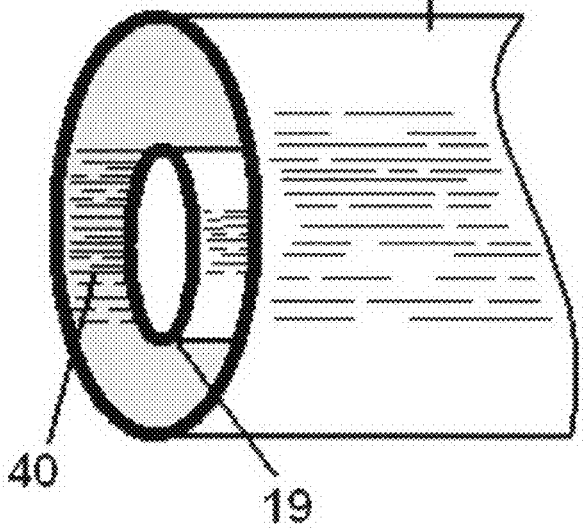
FIG. 5 is a perspective view of a nozzle end showing the interior conduit, where gray shading illustrates the interior of the fuel feed conduit.

Now referring to FIG. 5 and the sizing of the feed conduits 19, 32, the nitrous oxide feed conduit's 19 outside diameter and the fuel feed conduit's 32 inside diameter which are sized so to have sufficient area 40 between the two surfaces throughout the entire length of the fuel feed conduit 32 and to allow for a sufficient amount of fuel to be conveyed to the nozzle end 14.

Now referring to FIG. 4 which illustrates the positioning of the emitting nozzle end 14 of a fuel feed conduits 32 and nitrous oxide feed conduits 19 where they form the nozzle end 14 and spray the intake runners 29 or the intake port area 33 (not part of the present invention). Still referring to FIG. 4 in which positioning in or near the intake runners 29 can be achieved because of the malleability of the fuel feed conduits 32 and the nitrous oxide feed conduits 19.

In more detail, now referring to FIG. 4 and the present invention that increases the horsepower of an internal combustion engine by spraying nitrous oxide and fuel into the intake tract 29 of the said engine, this injection of nitrous oxide into the combustion chamber 35 via the intake tract 29 accomplishes this increase in horsepower because of the increase of oxygen as nitrous oxide has 36% oxygen by weight compared to 23% oxygen by weight in air. General accepted practices in the field will apply to the present invention and are well-known. When the term nitrous system is used herein it will be referring in a generic way to a commonly used nitrous oxide and fuel injection supply system (not part of this invention). The said common nitrous systems with its storage vessels and other component will supply the nitrous oxide and fuel to the present invention. Many other operational details will not be elaborated on here as they are well-known in the field.

Now referring to FIG. 1 and the present invention where nitrous oxide and fuel are supplied via the nitrous system and enters their respective supply ports 15, 16 independently under pressure from the nitrous system and are conveyed through passages in the module 10 and on to the two chamber collector assembly 11 via the supply conduits 12, 13.

Now referring to FIGS. 2 and 3 and the said two chamber collector assembly 11 where fuel is conveyed into the fuel feed conduits 32 and nitrous oxide is conveyed into the nitrous oxide conduits 19 as illustrated with the arrowed lines. The nitrous oxide and fuel travel their respective feed conduits 19, 32 and are emitted at the nozzle end 14 forming a mixture of nitrous oxide and fuel. Now referring to FIG. 4 and the nozzle end 14 which is positioned in the intake runner 29 and spraying (represented by random lines) the said mixture into the air and fuel mixture coming from the carburetor 27. Thus when the intake valve opens the air, nitrous oxide and fuel mixture will be transferred into the combustion chamber 35 by the intake stroke of the piston (not part of the present invention). Still referring to FIG. 4 and the installation of the present invention, during the positioning of the module 10 on the intake manifold 28 the fuel feed conduit or conduits 32 with their nozzle end or ends 14 would be manipulated so as to be either pointed at the intake runner 29 or extended into the intake runner 29 so their emitting nozzle ends 14 spray in the direction of the intake port area 33. In the preferred embodiment there would be one nozzle end 14 per intake runner 29.

The construction details of the invention as shown in FIG. 1 are that the module 10 is made of aluminum and is rectangular in shape to roughly match the intake manifold's 28 interior plenum area and the intake manifolds 28 outside dimensions so as to form a passage 41 from the carburetor 27 (not shown in this view) to the intake manifold 28 (not shown in this view) for the air and fuel mixture to pass. Furthermore the module 10 height is variable by application and generally would be around a ½ inch to 4 inches thick. Still referring to FIG. 1 and the supply ports 15, 16 which are drilled through the module 10 so as to form a passage to the supply conduits 12, 13 to convey their respective constituent. The said drilled passages are tapped from the outside of the module 10 to accept a common fitting used in the field, the said fitting would be threaded into the supply ports 15 and 16 from the exterior. Still referring to FIG. 1 and the supply conduits 12 and 13 that extend from the module's 10 supply ports 15 and 16 to the two chamber collector assembly 11 the said supply conduits 12 and 13 are affixed and sealed to the module 10 by two part epoxy. Still referring to the said supply conduits 12 and 13 which are sized for strength and flow and are made of tubular copper, in the preferred embodiment (6.35 mm) ¼ inch outside diameter tubing is used. Furthermore the supply conduits 12 and 13 act as supports for the two chamber collection assembly 11 and therefore are in pairs for stability and strength and are sealed and affixed to the two chamber collection assembly 11 by brazing.

Now referring to FIG. 2 and the two chamber collection assembly 11 which is cylindrical in shape and made of brass and being sized around (19.05 mm) ¾ to (38.1 mm) 1½ inch in diameter and (25.4 mm) 1 to (50.8 mm) 2 inches long so as to contain the nitrous collection chamber 18 and the fuel collection chamber 20 with substantial material around said chambers 18 and 20 and capable of containing the pressures to which said chambers 18 and 20 are subjected to. Still referring to FIG. 2 where all material making up the said chambers 18, 20 and forming the chambers 18, 20 are (3.175 mm) ⅛ inch to (6.35 mm) ¼ inch in thickness. The two chamber collector assembly 11 is machined on its outer surfaces to remove sharp edges 39 (Shown on one edge as an example), so as to be streamline to the flow of the air and fuel mixture from the carburetor 27 to the intake manifold 28. Still referring to FIG. 2 and the nitrous oxide collection chamber 18 that is machined to form a chamber area then plugged or capped 17 with similar material as the two chamber collector assembly 11 by a braze to form the nitrous oxide collection chamber 18. Referring still to FIG. 2 and the nitrous oxide collection chamber 18 and the nitrous oxide supply conduit 12 which only one said conduit 12 is shown, but two nitrous oxide supply conduit 12 are used in the preferred embodiment. Still referring to FIG. 2 and the nitrous oxide collection chamber 18 where is shown the nitrous oxide feed conduits 19 protruding above the floor 37 of the nitrous oxide collection chamber 18 around (3.58 mm) 1/16 to a (6.35 mm) ¼ inch the said nitrous oxide feed conduits 19 penetrate through holes drilled in the floor 37 of the nitrous oxide collection chamber 18, they are brazed to the nitrous oxide collection chamber 18 to affix and seal them to the chamber 18. Still referring to FIG. 2 and the two chamber collection assembly 11 which also houses a second chamber 20 for fuel this fuel collection chamber 20 is separated from the nitrous oxide collection chamber 18 by a (3.175 mm) ⅛ to a (6.35 mm) ¼ inch of material. Still referring to FIG. 2 and the said fuel collection chamber 20 with its fuel feed conduits 32 the said fuel feed conduit or conduits 32 and the fuel supply conduit or conduits 13 are securely affixed and sealed to the two chamber collector assembly 11 by brazing. The length of the fuel feed conduits 32 and the length of the nitrous feed conduit 19 are variable by the application and the particular intake manifold 28 and engine that it will be used on, in some situation the said feed conduits 32 and 19 may be kept extra long and cut during the installation. Referring now to FIG. 1 and the fuel feed conduits 32 that are made of soft copper around (6.35 mm) ¼ inch outside diameter so as to accommodate the nitrous oxide feed conduit 19 that traverses their interior and also flow a sufficient fuel supply to the nozzle end 14. The said nitrous oxide feed conduits 19 are made of a copper tubing familiarly know as capillary tubing in the air conditioning and refrigeration field and in the preferred embodiment are around (0.711 mm) 0.028 to (1.066 mm) 0.042 inch inside diameter depending on the horsepower increase wanted.

Referring now to FIG. 2 and the fuel collection chamber 20 the said fuel collection, chamber 20 is formed by the drilled holes for the fuel feed conduits 32 and the fuel supply conduits 13, work with a carbide burr tool through the said openings is done to open up the fuel collection chamber 20.

Figure 6:
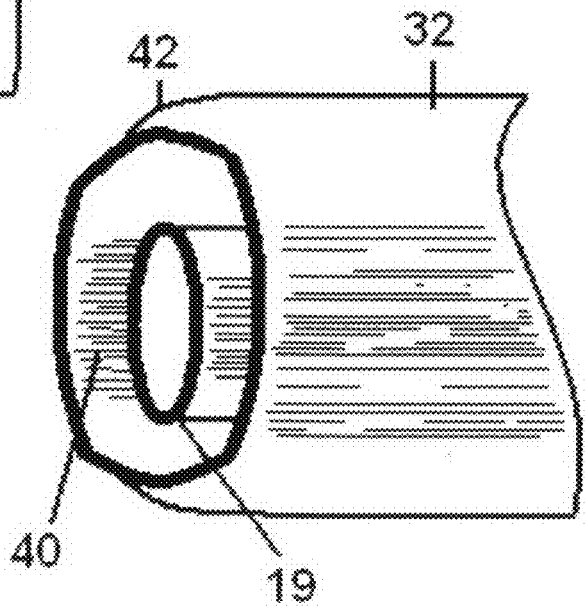
FIG. 6 is a perspective view of a nozzle end detail.

Now referring to FIG. 6 and the nozzle ends 14 and the fuel feed conduit or conduits 32 that are finished with a smooth and beveled end 42 so as to aid in the installation process as the module 10 and the nozzle end or ends 14 are manipulated into position.

Now referring to FIG. 4 which is a simplified cross sectional view that shows the nozzle end 14, being relatively centered in the intake runners 29 to minimize fuel pooling in the intake runners 29.

The construction details of the invention as shown in FIG. 1 are that the module 10 is made of aluminum, but of course the module 10 could be made of another material with sufficient rigidity such as stainless steel, brass, or plastic and is rectangular in shape, but of course could be another shape such as round or oval to roughly match the intake manifold's 28 interior plenum area and the intake manifolds 28 outside dimensions so as to form a passage from the carburetor 27 to the intake manifold 28 for the air and fuel mixture to pass or could be shape to match a throttle body or another area of the intake tract. Still referring to FIG. 1 and the supply ports 15, 16 which are drilled through the module 10, but of coarse could be cast into the module 10 or made by another process so as to form a passage to the supply conduits 12, 13 and convey their respective constituent. The said drilled passages are tapped from the outside of the module 10 to accept a common fitting used in the field, the said fitting would be threaded into said supply ports 15 and 16 from the exterior, but of course could be affixed and seal by other means such as epoxy or brazed. Still referring to FIG. 1 and the supply conduits 12 and 13 that extend from the module's 10 supply ports 15 and 16 to the two chamber collector assembly 11 the said supply conduits 12 and 13 are affixed and sealed to the module 10 by two part epoxy. Still referring to the said supply conduits 12 and 13 which are sized for strength and flow and are made of tubular copper, in the preferred embodiment (6.35 mm) ¼ inch outside diameter tubing is used. Furthermore the supply conduits 12 and 13 act as supports for the two chamber collection assembly 11 and therefore are in pairs for stability and strength and are sealed and affixed to the two chamber collection assembly 11 by brazing, but of course could be affixed and seal by other means such as solder or epoxy. The supply conduits 12 and 13 are sized for strength and flow and are made of tubular copper, but of course could be made another material such as stainless steel or plastic. In the preferred embodiment (6.35 mm) ¼ inch outside diameter tubing is used, but of course the tubing could be another size such as (9.525 mm) ⅜ inch or smaller than (6.35 mm) ¼ inch. Furthermore the supply conduits 12 and 13 act as supports for the two chamber collection assembly 11 and therefore are in pairs for stability and strength and are seal and affixed to the two chamber collection assembly 11 by brazing, but of course could be affixed and seal by other means such as epoxy or soldering. Further the module 10 could be eliminated entirely with said common fittings affixed directly to the supply conduits 12 and 13 or could be another shape to be used on a fuel injected engine or, two or single barrel carburetor 27.

Now referring to FIG. 2 and the two chamber collection assembly 11 which is machined from brass but could be cast or molded, or made by other means and is cylindrical in shape, but of course could be another shape such as square or clover shape and is made of brass; but could of course be made of another material such as stainless steel or plastic and being sized around (19.05 mm) ¾ to (38.1 mm) 1 ½ inch in diameter and (25.4 mm) 1 to (50.8 mm) 2 inches long and large enough to contain the nitrous collection chamber 18 and the fuel collection chamber 20 with substantial material around said chambers 18 and 20 so as to contain the pressures to which said chambers 18 and 20 are subjected to, but of course could be other dimensions. Still referring to FIG. 2 where all material surrounding the said chambers 18 and 20 and forming the chambers 18 and 20 with surrounding materials of (3.175 mm) ⅛ inch to (6.35 mm) ¼ inch in thickness, but could be a different thickness. The two chamber collector assembly 11 is machined on its outer surfaces to remove sharp edges so as to be streamline to the flow of the air and fuel mixture from the carburetor 27 to the intake manifold 28, but of course could be made without removing sharp edges or not be made streamline. Still referring to FIG. 2 and the nitrous oxide collection chamber 18 that is machined to form an open area then plugged or capped 17 with similar material as the two chamber collector assembly 11 by a braze to form the nitrous oxide collection chamber 18, but of course the chambers 18 and 20 could be made in another means or capped other means such as threads or soldered or even a dissimilar material. Referring still to FIG. 2 and the nitrous oxide collection chamber 18 and the nitrous oxide supply conduit 12 which only one said nitrous oxide supply conduit 12 is shown for clarity but two nitrous oxide supply conduit 12 are used in the preferred embodiment, but could of course be made with a different number of nitrous oxide supply conduit 12.

Still referring to FIG. 2 and the nitrous oxide collection chamber 18 where is shown the nitrous oxide feed conduits 19 protruding above the floor 37 of the nitrous oxide collection chamber 18 around (1.58 mm) 1/16 to (6.35 mm) ¼ inch the said nitrous oxide feed conduits 19 go through holes drilled in the floor 37 of the nitrous oxide collection chamber 18, they are brazed to the nitrous oxide collection chamber 18 to affix and seal them, but of course they could be sealed and affixed by other means such as potting in epoxy or soldered and of course they would not have to protrude above the floor area. Still referring to FIG. 2 and the said fuel collection chamber 20 with its fuel feed conduit or conduits 32 the said fuel feed conduit or conduits 32 and the fuel supply conduit or conduits 13 are securely affixed 36 and sealed to the two chamber collector assembly 11 by brazing, but of course could be affixed and seal by other means such as an o-ring, soldered or a flare fit. The length of the fuel feed conduits 32 and the length of the nitrous feed conduit 19 are variable by the application and the particular intake manifold 28 and engine that it will be used on, in some situation the said feed conduits 32 and 19 could be kept extra long and cut during the installation, but of course they could be of a single length.

Referring now to FIG. 1 and the fuel feed conduits 32 that are made of soft copper around (6.35 mm) ¼ inch outside diameter, but of course could be made of other materials such as stainless steel or plastic and be of another size so as to accommodate the nitrous oxide feed conduit 19 that traverses their interior and also flow a sufficient fuel supply to the nozzle end 14. The said nitrous oxide feed conduits 19 are made of a copper tubing familiarly know as capillary tubing in the air conditioning and refrigeration field and in the preferred embodiment are around (0.711 mm) 0.028 to (1.066 mm) 0.042 inch inside diameter depending on the horsepower increase wanted, but of course could be made of other materials such as stainless steel or plastic and be of another size.

Referring now to FIG. 2 and the fuel collection chamber 20 the said fuel collection chamber 20 is formed by the drilled holes for the fuel feed conduits 32 and the fuel supply conduits 13, work with a carbide burr tool through the said openings is done to open up the fuel collection chamber 20, but the said fuel collection chamber 20 could be made by other means such as cast or capped and solder, brazed or two part epoxy or burr tool not used.

Now referring to FIG. 6 and the nozzle ends 14 and the fuel feed conduits 32 that is finished with a smooth and beveled end so as to aid in the installation process as the module 10 and the nozzle end or ends 14 are manipulated into position and are relatively centered in the intake runners 29 so as to minimize pooling of fuel in the intake runners 29 as shown in FIG. 4, but of course the said nozzle ends 14 could be left with sharp edges or even a type of ring or ball installed or formed near or at the nozzle end 14 to aid installation. Furthermore the nozzle ends 14 could be constricted by some means so as to aid mixing of the nitrous oxide and the fuel or some type of an insert or constriction by other means. Many alternative nozzle 14 designs could be used although only a few have been mentioned. Furthermore the nozzle end or ends 14 could be positioned in many different locations from spraying at or near the intake runner or runners 29 to spraying directly at the intake port or ports 33.

The foregoing preferred embodiments are believed to have the convenience of a module or plate installation with horsepower gains closer to that of nozzle type injection; because of the novel design of the feed conduit 19 within feed conduit 32 and their malleability allowing them to be pointed at the intake runner or at the intake port, and the two chamber collection assembly's 11 construction that routes the fuel and nitrous oxide to the feed conduits 19, 32.

While preferred embodiments of the present invention have been disclosed herein for those skilled in the art it will be understood that many variations and modification may be made thereto without departing from the spirit of the invention as set forth herein.

I claim:

1. A nitrous oxide and fuel injection apparatus for an engine comprising: a module adapted to be positioned between a carburetor or throttle body and an intake manifold, said module having a supply port for fuel and a supply port for nitrous oxide, said module defining an opening to communicate air from the carburetor or throttle body to the intake manifold and a collector assembly located within said opening, at least one first conduit communicating said fuel supply port to a first chamber in said collector, at least one second conduit communicating said nitrous oxide supply port to a second chamber in said collector assembly, at least one third conduit adapted to extend from said first chamber into said intake manifold, at least one forth conduit adapted to extend from said second chamber into said intake manifold, and wherein each third conduit is coaxially disposed with respect to each forth conduit and defining a nozzle at their ends for mixing fuel and nitrous oxide in said intake manifold.

2. The apparatus of claim 1, comprising an intake manifold and the number of third and forth conduits corresponding to the number of engine cylinders with each nozzle directing fuel and nitrous oxide to each cylinder.

3. The apparatus of claim 2, wherein each said nozzle is located proximate an intake port of said cylinder.

4. The apparatus of claim 2, wherein said third and forth conduits are generally coaxial with a intake runner of said intake manifold.

5. The apparatus of claim 1, wherein said first chamber shares a wall with said second chamber.

6. The apparatus of claim 1, wherein one of said third or forth conduits extend through said wall.

* * * * *